US006918857B2

(12) United States Patent
Chen

(10) Patent No.: US 6,918,857 B2
(45) Date of Patent: Jul. 19, 2005

(54) EXERCISING STEPPER

(76) Inventor: Tsung-Yu Chen, 58, Ma Yuan West St., Taichung (TW)

( * ) Notice: Subject to any disclaimer, the term of this patent is extended or adjusted under 35 U.S.C. 154(b) by 2 days.

(21) Appl. No.: 10/730,719

(22) Filed: Dec. 5, 2003

(65) Prior Publication Data

US 2005/0124465 A1 Jun. 9, 2005

(51) Int. Cl.[7] ..... A63B 22/04
(52) U.S. Cl. ..... 482/53
(58) Field of Search ..... 482/909, 57–65, 482/51–53, 79–80

(56) References Cited

U.S. PATENT DOCUMENTS 5,545,111 A * 8/1996 Wang et al. ..... 482/53
5,628,709 A * 5/1997 Chen ..... 482/53
5,888,175 A * 3/1999 Chang ..... 482/53
6,224,515 B1 * 5/2001 Chen ..... 482/53
6,315,697 B1 * 11/2001 Chen ..... 482/53
6,709,366 B2 * 3/2004 Chuang ..... 482/53

* cited by examiner

*Primary Examiner*—Stephen R. Crow
(74) *Attorney, Agent, or Firm*—Alan D. Kamrath; Nikolai & Mersereau, P.A.

(57) ABSTRACT

An exercising stepper includes a support base, a pivot tube, two pedals, and two hydraulic cylinders. The support base includes a front support foot, a rear support foot, a support bar, a main bar, mounting member, a support seat, two support rods, two tubular rotation members, and two suspension members. Thus, the support base is integrally formed with the support bar, so that the force applied on the support base is distributed by the front support foot, the rear support foot and the support bar.

4 Claims, 5 Drawing Sheets

EXERCISING STEPPER

BACKGROUND OF THE INVENTION

1. Field of the Invention

The present invention relates to an exercising stepper, and more particularly to an exercising stepper having a simplified construction and enhanced structural strength.

2. Description of the Related Art

A conventional exercising stepper in accordance with the prior art is disclosed in the Taiwanese Patent Publication No. 384716, and comprises a shaft tube having a periphery formed with two slots, a pivot member pivotally mounted in the shaft tube and provided with two catch rods each protruded outward from the shaft tube and slidably mounted in a respective one of the two slots, two pedals each pivotally mounted on the shaft tube and each provided with a suspension rod rested on a respective one of the two catch rods of the pivot member.

In operation, when either one of the two pedals is stepped downward by the user's one foot, the suspension rod of the pedal is moved to push and move the respective catch rod which rotates the pivot member to move the other catch rod which pushes and moves the suspension rod of the other pedal so as to move the other pedal upward. Thus, when either one of the two pedals is stepped downward by the user's one foot, the other pedal is moved upward synchronously.

However, the shaft tube needs to form two slots in the working process, thereby increasing costs of fabrication. In addition, the shaft tube is formed two slots, thereby decreasing the structural strength of the shaft tube. Further, the load of the whole exercising stepper is completely concentrated on the shaft tube, thereby decreasing the lifetime of the shaft tube.

SUMMARY OF THE INVENTION

The primary objective of the present invention is to provide an exercising stepper having a simplified construction and enhanced structural strength.

Another objective of the present invention is to provide an exercising stepper, wherein the support base is integrally formed with the support bar, so that the force applied on the support base is distributed by the front support foot, the rear support foot and the support bar.

A further objective of the present invention is to provide an exercising stepper, wherein the pivot tube has a simplified construction, thereby decreasing costs of fabrication and facilitating assembly of the exercising stepper.

A further objective of the present invention is to provide an exercising stepper, wherein the pivot tube is not formed with any slot, thereby enhancing the structural strength of the exercising stepper.

In accordance with the present invention, there is provided an exercising stepper, comprising a support base, a pivot tube, two pedals, and two hydraulic cylinders, wherein:

- the support base is integrally formed with a front support foot, a rear support foot, a support bar, a main bar, mounting member, and a support seat;
- the main bar is connected between the front support foot and the rear support foot;
- the support bar has a lower end mounted on the rear support foot;
- the mounting member is mounted on a lower side of an upper end of the support bar;

- the support base includes two support rods, two tubular rotation members, and two suspension members;
- the two support rods are mounted on two sides of the upper end of the support bar;
- each of the two rotation members is rotatably mounted on a respective one of the two support rods;
- each of the two suspension members is fixed on a respective one of the two rotation members to rotate therewith;
- each of the two pedals has a first end fixed on a respective one of the two rotation members to rotate therewith;
- each of the hydraulic cylinders has a first end pivotally mounted on a second end of a respective one of the two pedals and a second end pivotally mounted on the front support foot;
- the support seat is mounted on a connection of the front support foot and the first end of the main bar;
- the pivot tube is pivotally mounted between the mounting member and the support seat and has a periphery formed with two opposite catch portions each rested on a respective one of the suspension members.

Further benefits and advantages of the present invention will become apparent after a careful reading of the detailed description with appropriate reference to the accompanying drawings.

DETAILED DESCRIPTION OF THE INVENTION

Figure 1:
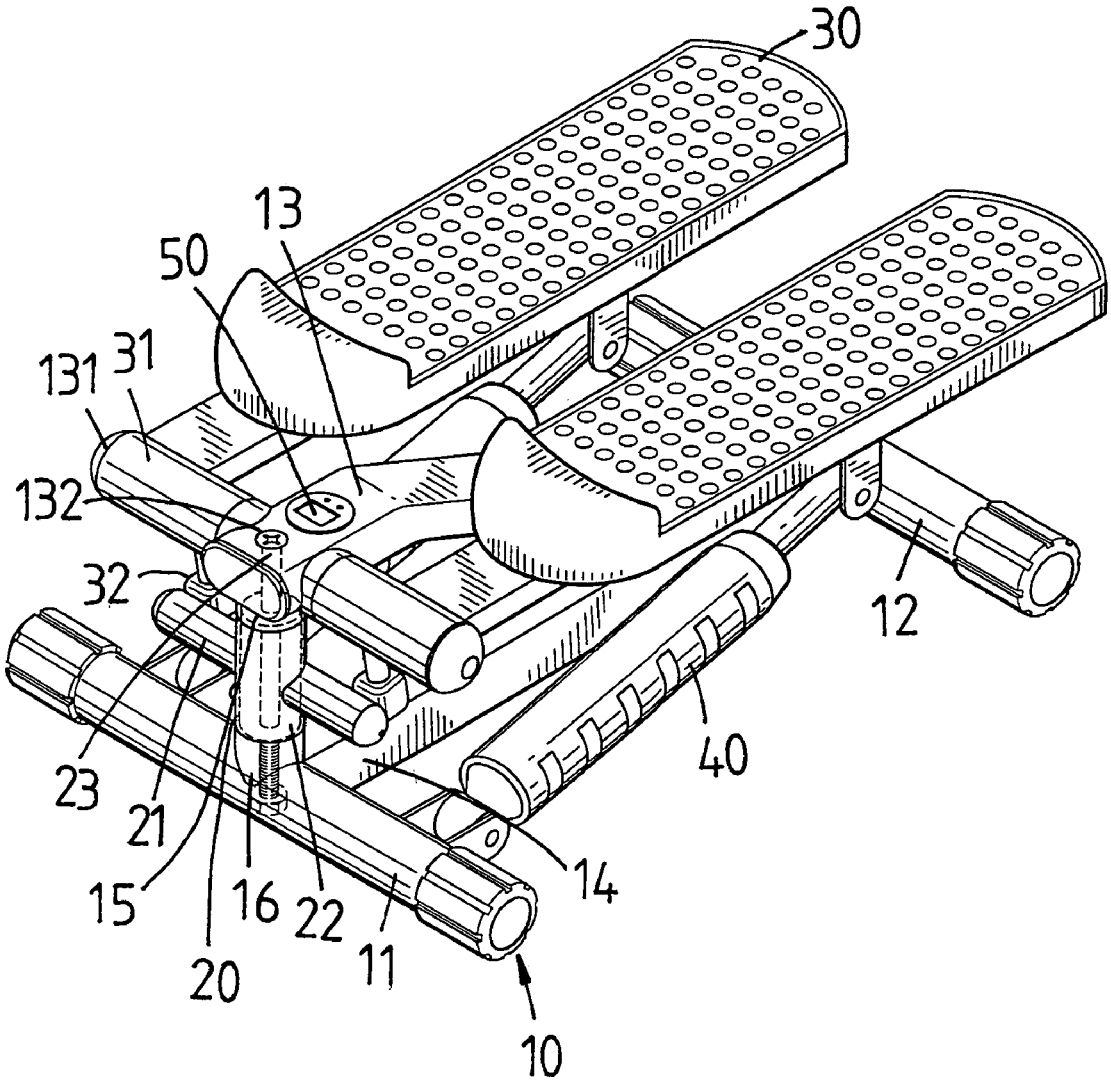
FIG. 1 is a perspective view of an exercising stepper in accordance with the preferred embodiment of the present invention.
Figure 2:
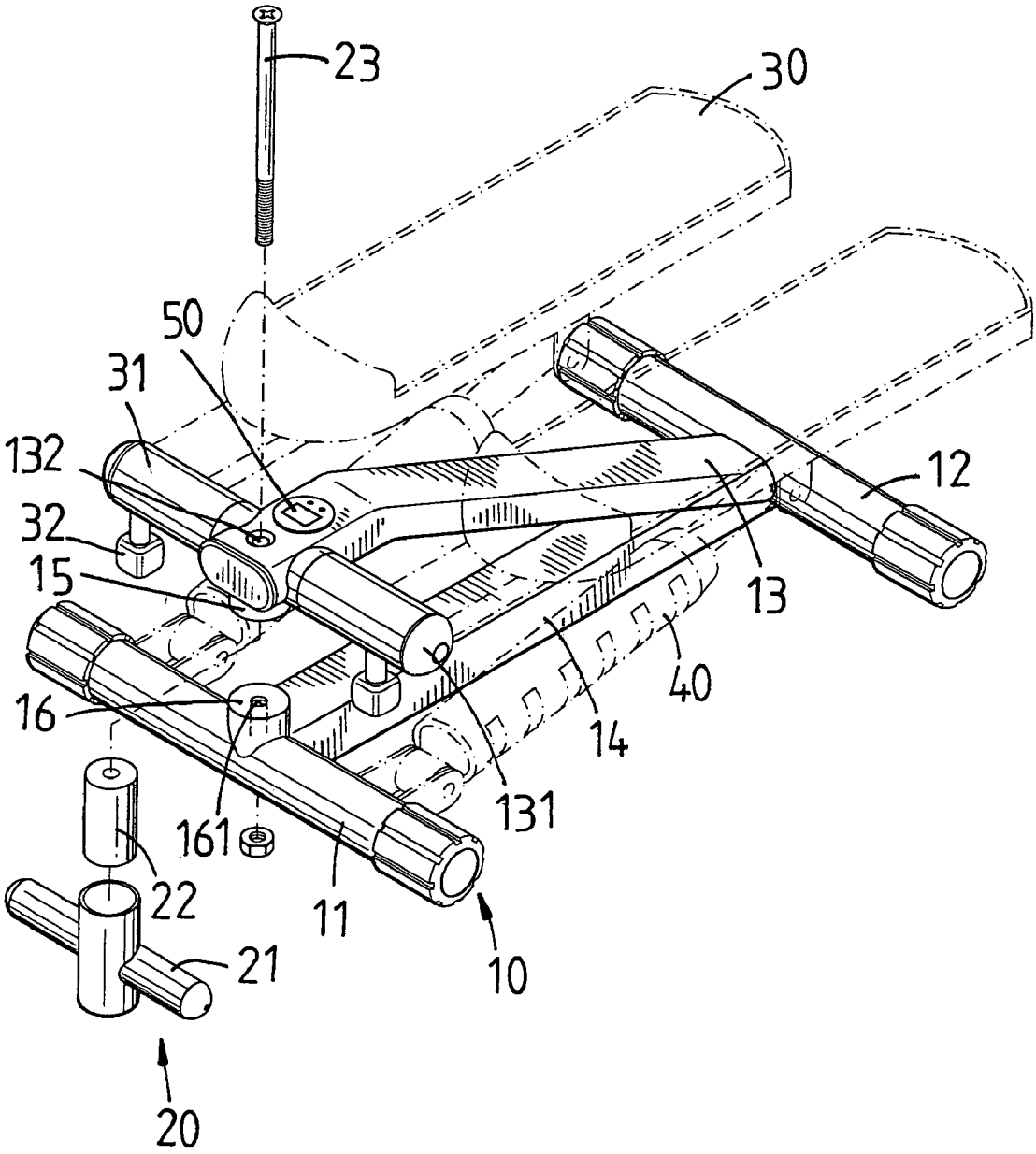
FIG. 2 is a partially exploded perspective view of the exercising stepper in accordance with the preferred embodiment of the present invention.
Figure 3:
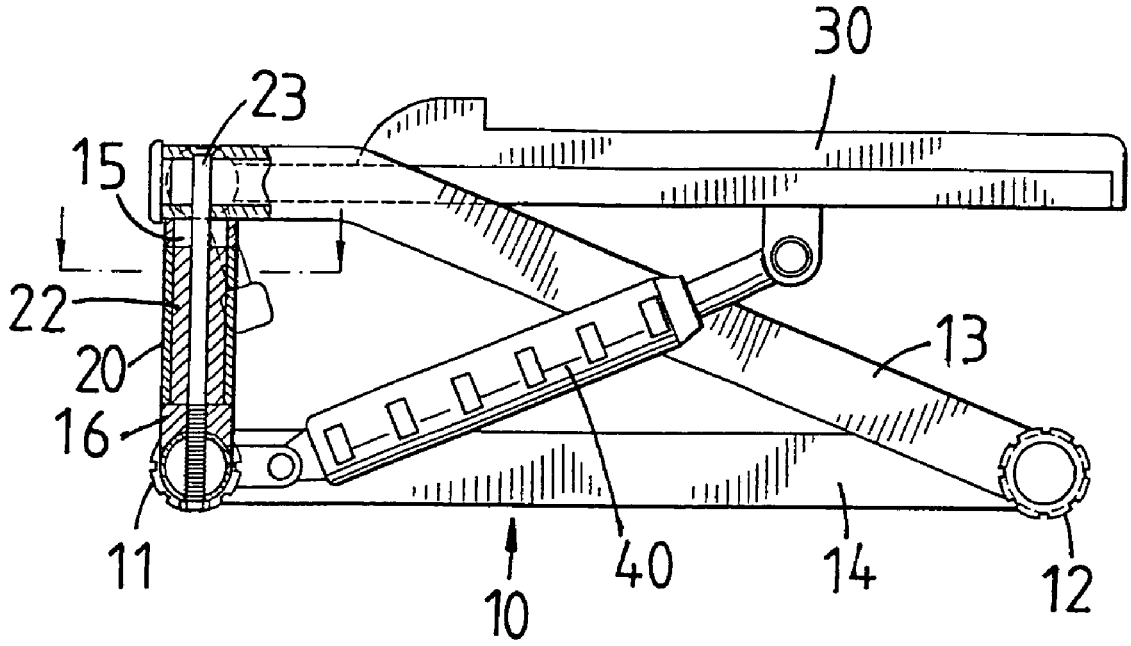
FIG. 3 is a partially plan cross-sectional view of the exercising stepper as shown in FIG. 1.
Figure 4:
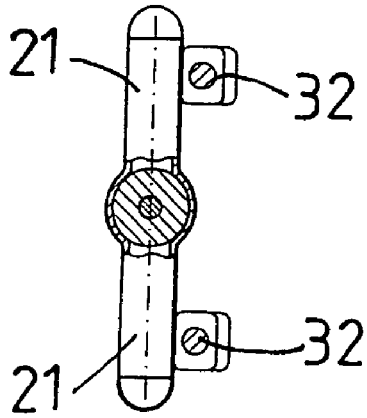
FIG. 4 is a partially cross-sectional view of the exercising stepper as shown in FIG. 3.

Referring to the drawings and initially to FIGS. 1–4, an exercising stepper in accordance with the preferred embodiment of the present invention comprises a support base 10, a pivot tube 20, two pedals 30, two hydraulic cylinders 40, and a counter 50.

The structure and function of the two pedals 30, hydraulic cylinders 40 and counter 50 are conventional and will not be further described in detail.

The support base 10 includes a main bar 14, a front support foot 11, a rear support foot 12, a support bar 13, a hollow mounting member 15, two support rods 131, two tubular rotation members 31, two suspension members 32, and a support seat 16.

Preferably, the support base 10 is integrally formed with the front support foot 11, rear support foot 12, support bar 13, main bar 14, mounting member 15 and support seat 16.

The front support foot 11 is mounted on a first end of the main bar 14. The rear support foot 12 is mounted on a second end of the main bar 14. The front support foot 11, the rear support foot 12 and the main bar 14 form a substantially I-shaped structure.

The support bar 13 has a lower end mounted on the rear support foot 12. The support bar 13 is inclined relative to the main bar 14, so that the support bar 13 and the main bar 14 form a substantially V-shaped structure. The mounting member 15 is mounted on a lower side of a bent upper end of the support bar 13 and has a top formed with a first screw bore 132. The counter 50 is mounted on the upper end of the support bar 13 and is located beside the first screw bore 132 of the support bar 13.

Each of the two support rods 131 is mounted on the upper end of the support bar 13. Each of the two rotation members 31 is rotatably mounted on a respective one of the two support rods 131. Each of the two suspension members 32 is fixed on a respective one of the two rotation members 31 to rotate therewith. Each of the two pedals 30 has a first end fixed on a respective one of the two rotation members 31 to rotate therewith. Each of the two pedals 30 in inclined relative to a respective one of the suspension members 32. Each of the hydraulic cylinders 40 has a first end pivotally mounted on a second end of a respective one of the two pedals 30 and a second end pivotally mounted on the front support foot 11.

The support seat 16 having a cylindrical shaped is mounted on a connection of the front support foot 11 and the first end of the main bar 14 and has an inside formed with a second screw bore 161.

The pivot tube 20 is pivotally mounted between the mounting member 15 and the support seat 16 and has a periphery formed with two opposite catch portions 21 each rested on a respective one of the suspension members 32.

The exercising stepper further comprises a bushing 22 mounted in the pivot tube 20 so that the pivot tube 20 is pivoted conveniently, and a screw member 23 extended through the first screw bore 132 of the support bar 13 and the bushing 22, and screwed into the second screw bore 161 of the support seat 16, so that the pivot tube 20 is combined with the support base 10.

Figure 5:
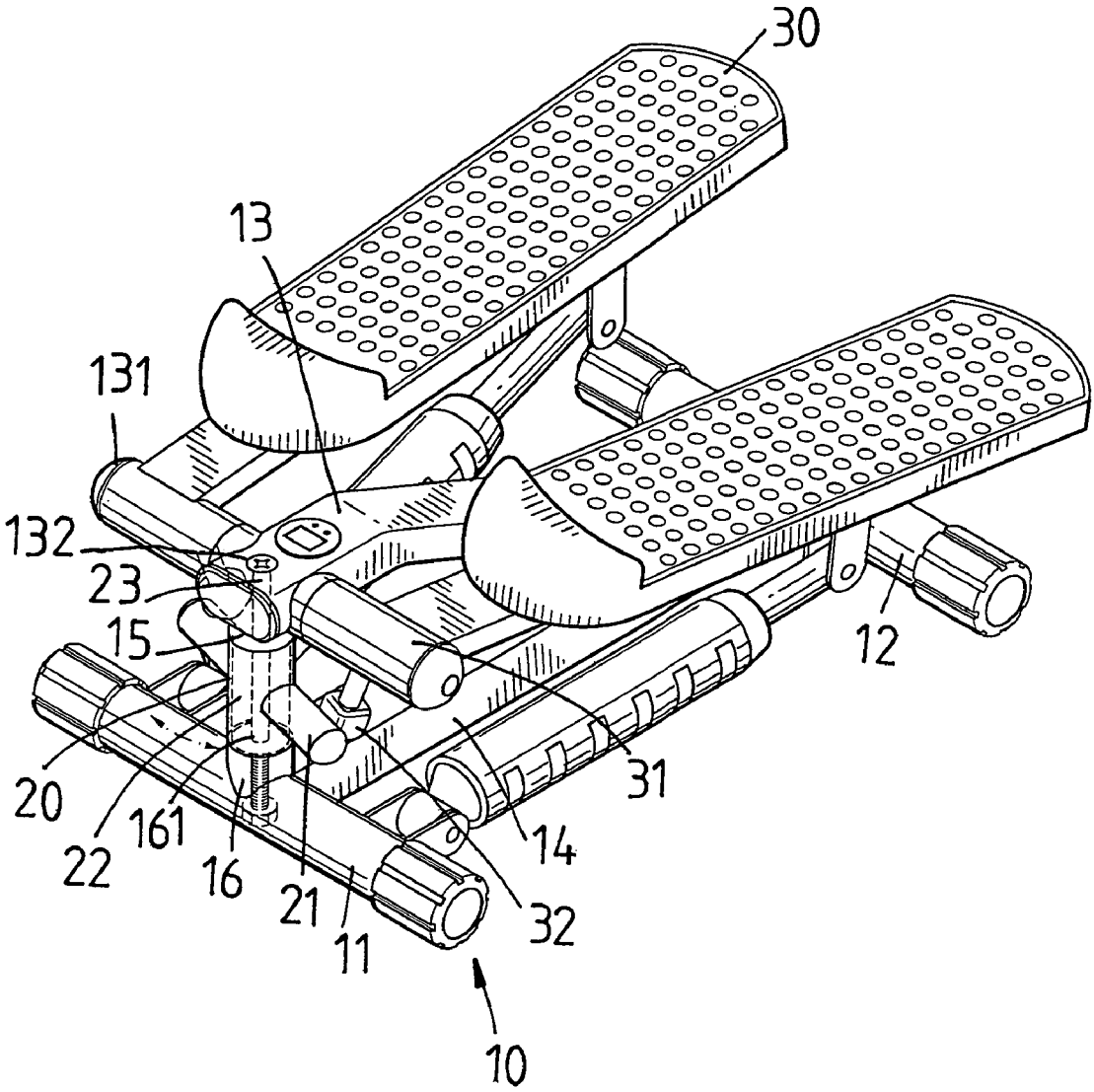
FIG. 5 is a schematic operational view of the exercising stepper as shown in FIG. 1.
Figure 6:
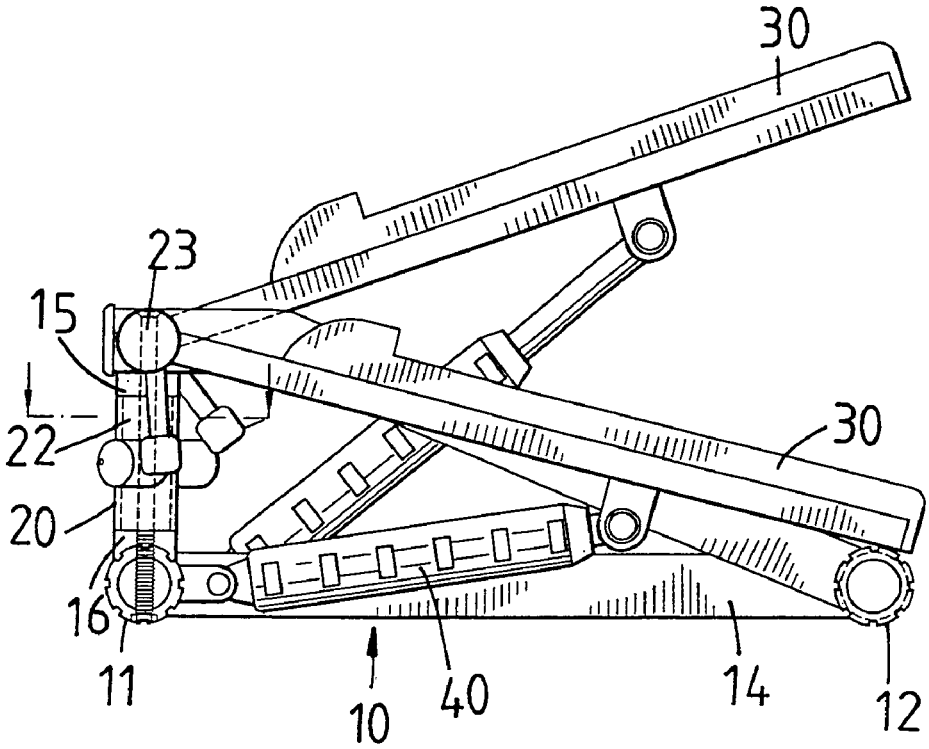
FIG. 6 is a schematic operational view of the exercising stepper as shown in FIG. 3.
Figure 7:
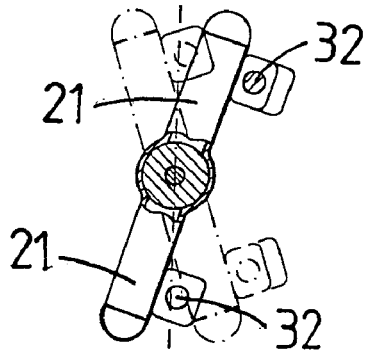
FIG. 7 is a schematic operational view of the exercising stepper as shown in FIG. 4.

In operation, referring to FIGS. 1–7, when either one of the two pedals 30 is stepped downward by the user's one foot as shown in FIGS. 5 and 6, the respective rotation member 31 is rotated by the pedal 30, so that the respective suspension member 32 is moved by rotation of the rotation member 31 to push and move the respective catch portion 21 which rotates the pivot tube 20 to move the other catch portion 21 which pushes and moves the other suspension member 32 which rotates the other rotation member 31 which moves the other pedal 30 upward as shown in FIG. 6. Thus, when either one of the two pedals 30 is stepped downward by the user's one foot, the other pedal 30 is moved upward synchronously.

Accordingly, the support base 10 is integrally formed with the support bar 13, so that the force applied on the support base 10 is distributed by the front support foot 11, the rear support foot 12 and the support bar 13. In addition, the pivot tube 20 has a simplified construction, thereby decreasing costs of fabrication and facilitating assembly of the exercising stepper. Further, the pivot tube 20 is not formed with any slot, thereby enhancing the structural strength of the exercising stepper.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An exercising stepper, comprising a support base, a pivot tube, two pedals, and two hydraulic cylinders, wherein:

the support base is integrally formed with a front support foot, a rear support foot, a support bar, a main bar, mounting member, and a support seat;

the main bar is connected between the front support foot and the rear support foot;

the support bar has a lower end mounted on the rear support foot;

the mounting member is mounted on a lower side of an upper end of the support bar;

the support base includes two support rods, two tubular rotation members, and two suspension members;

the two support rods are mounted on two sides of the upper end of the support bar;

each of the two rotation members is rotatably mounted on a respective one of the two support rods;

each of the two suspension members is fixed on a respective one of the two rotation members to rotate therewith;

each of the two pedals has a first end fixed on a respective one of the two rotation members to rotate therewith;

each of the hydraulic cylinders has a first end pivotally mounted on a second end of a respective one of the two pedals and a second end pivotally mounted on the front support foot;

the support seat is mounted on a connection of the front support foot and the first end of the main bar;

the pivot tube is pivotally mounted between the mounting member and the support seat and has a periphery formed with two opposite catch portions each rested on a respective one of the suspension members.

2. The exercising stepper in accordance with claim 1, wherein the mounting member has a top formed with a first screw bore, the support seat has an inside formed with a second screw bore, and the exercising stepper further comprises a screw member extended through the first screw bore of the support bar and screwed into the second screw bore of the support seat, so that the pivot tube is combined with the support base.

3. The exercising stepper in accordance with claim 1, wherein the support bar is provided with a counter.

4. The exercising stepper in accordance with claim 1, further comprising a bushing mounted in the pivot tube.

* * * * *